US012060874B2

(12) United States Patent
Taras et al.

(10) Patent No.: US 12,060,874 B2
(45) Date of Patent: Aug. 13, 2024

(54) SYSTEMS AND METHODS FOR COMPRESSOR DESIGN

(71) Applicant: Goodman Global Group, Inc., Waller, TX (US)

(72) Inventors: Michael F Taras, The Woodlands, TX (US); Khaled H Saleh, Katy, TX (US); Ying Gong, Fulshear, TX (US)

(73) Assignee: Goodman Global Group, Inc., Waller, TX (US)

( * ) Notice: Subject to any disclaimer, the term of this patent is extended or adjusted under 35 U.S.C. 154(b) by 172 days.

(21) Appl. No.: 16/798,839

(22) Filed: Feb. 24, 2020

(65) Prior Publication Data

US 2021/0262461 A1 Aug. 26, 2021

(51) Int. Cl.
*F04B 43/00* (2006.01)
*F04B 51/00* (2006.01)

(52) U.S. Cl.
CPC ..... *F04B 43/0081* (2013.01); *F04B 51/00* (2013.01); *F25B 2500/18* (2013.01); *F25B 2500/19* (2013.01)

(58) Field of Classification Search
CPC ..... F25B 2500/18; F25B 2500/19; F04B 49/065; F04B 51/00
See application file for complete search history.

(56) References Cited

U.S. PATENT DOCUMENTS 4,062,199 A * 12/1977 Kasahara ..... F04C 29/0007 62/197
2003/0215336 A1* 11/2003 Hattori ..... F04C 28/125 417/53
2009/0037143 A1 2/2009 Saunders
2010/0186433 A1* 7/2010 Galante ..... F04C 23/001 62/115
2010/0314458 A1 12/2010 Votaw et al.
2013/0091892 A1 4/2013 Nemit, Jr. et al.
2015/0093273 A1 4/2015 Johnson et al.

FOREIGN PATENT DOCUMENTS

KR 101327420 B1 11/2013

OTHER PUBLICATIONS

Younghwan et al., 'The selection of volume ratio of two-stage rotary compressor and its effects on air-to-water heat pump with flash tank cycle', Dec. 2012 (Year: 2012).*
Reindl et al., Selection of Screw Compressor for Energy Efficient Operation (2003), Industrial Refrigeration Consortium—Univ. of Wisconsin-Madison (Year: 2003).*
ISA/KR, International Search Report and Written Opinion for corresponding PCT Application No. PCT/US2021/014508 filed Jan. 22, 2021.

* cited by examiner

*Primary Examiner* — Kenneth J Hansen
(74) *Attorney, Agent, or Firm* — K&L Gates LLP

(57) ABSTRACT

A method for designing a compressor operable to compress a refrigerant. The method may include determining operating conditions for the compressor. The method may also include weighting the operating conditions. The method further include determining a compressor volume ratio based on the refrigerant and the weighted operating conditions.

9 Claims, 4 Drawing Sheets

SYSTEMS AND METHODS FOR COMPRESSOR DESIGN

BACKGROUND

This section is intended to provide relevant background information to facilitate a better understanding of the various aspects of the described embodiments. Accordingly, these statements are to be read in this light and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses compressors and other flow-control devices to manipulate the refrigerant's flow and pressure, causing the refrigerant to cycle between the liquid and gas phases. Generally, these phase transitions occur within the HVAC system heat exchangers, which are part of the closed loop and designed to transfer heat between the circulating refrigerant and flowing ambient air. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers—transitioning between phases along the way—absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

For both heating and cooling of indoor spaces, the efficiency of a typical HVAC system is largely determined by the efficiency of the compressor used to compress and discharge gas-phase refrigerant. Therefore, an increase in system efficiency and reduction in system operational costs can be achieved by increasing the efficiency and reducing the compression losses of the compressor.

BRIEF DESCRIPTION OF THE DRAWINGS

Embodiments of the methods of designing a compressor are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes systems and methods for designing a compressor. Furthermore, the methods and systems are developed to optimize the volume ratio of the compressor—which, in certain embodiments, increases the efficiency and reduces pump losses during operation of the compressor.

Figure 1:
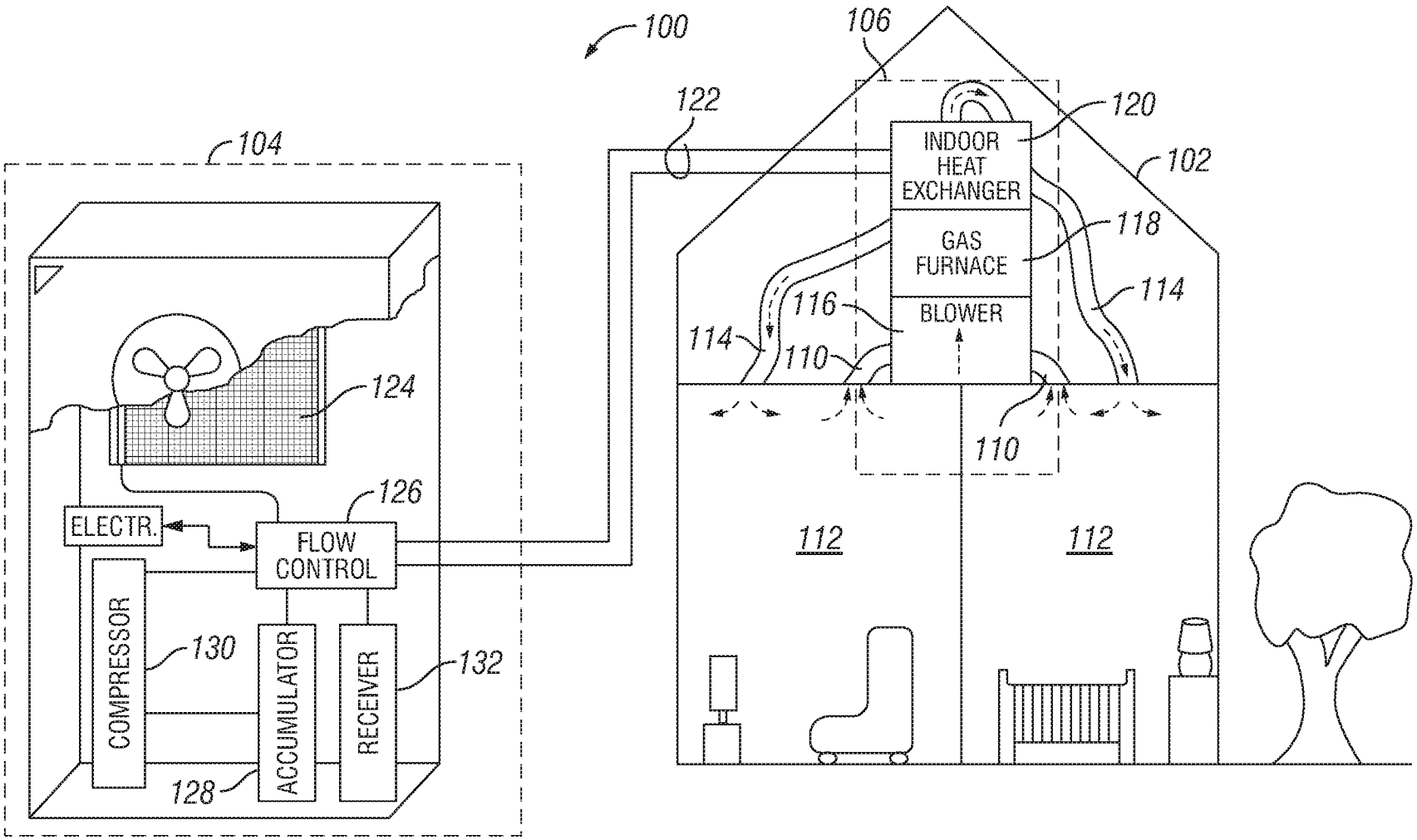
FIG. 1 is a block diagram of an HVAC system, according to one or more embodiments.

Turning now the figures, FIG. 1 is an HVAC system 100 in accordance with one embodiment. As depicted, the system 100 provides heating and cooling for a residential structure 102. However, the concepts disclosed herein are applicable to numerous of heating and cooling situations, which include industrial and commercial settings.

The described HVAC system 100 divides into two primary portions: The outdoor unit 104, which mainly comprises components for transferring heat with the environment outside the structure 102; and the indoor unit 106, which mainly comprises components for transferring heat with the air inside the structure 102. To heat or cool the illustrated structure 102, the indoor unit 106 draws ambient indoor air via returns 110, passes that air over one or more heating/cooling elements (i.e., sources of heating or cooling), and then routes that conditioned air, whether heated or cooled, back to the various climate-controlled spaces 112 through ducts or ductworks 114—which are relatively large pipes that may be rigid or flexible. A blower 116 provides the motivational force to circulate the ambient air through the returns 110 and the ducts 114. Additionally, although a split system is shown in FIG. 1, the disclosed embodiments can be equally applied to the packaged or other types of system configurations.

As shown, the HVAC system 100 is a "dual-fuel" system that has multiple heating elements, such as an electric heating element or a gas furnace 118. The gas furnace 118 located downstream (in relation to airflow) of the blower 32 combusts natural gas to produce heat in furnace tubes (not shown) that coil through the gas furnace 118. These furnace tubes act as a heating element for the ambient indoor air being pushed out of the blower 116, over the furnace tubes, and into the ducts 114. However, the gas furnace 118 is generally operated when robust heating is desired. During conventional heating and cooling operations, air from the blower 116 is routed over an indoor heat exchanger 120 and into the ductwork 114. The blower 116, the gas furnace 118, and the indoor heat exchanger 120 may be packaged as an integrated air handler unit, or those components may be modular. In other embodiments, the positions of the gas furnace 118, the indoor heat exchanger 120, and the blower 116 can be reversed or rearranged.

In at least one embodiment, the indoor heat exchanger 120 acts as a heating or cooling means that add or removes heat from the structure, respectively, by manipulating the pressure and flow of refrigerant circulating within and between the indoor and outdoor units via refrigerant lines 122. In another embodiment, the refrigerant could be circulated to only cool (i.e., extract heat from) the structure, with heating provided independently by another source, such as, but not limited to, the gas furnace 118. In other embodiments, there may be no heating of any kind. HVAC systems 100 that use refrigerant to both heat and cool the structure 102 are often described as heat pumps, while systems 100 that use refrigerant only for cooling are commonly described as air conditioners.

Whatever the state of the indoor heat exchanger 120 (i.e., absorbing or releasing heat), the outdoor heat exchanger 124 is in the opposite state. More specifically, if heating is desired, the illustrated indoor heat exchanger 120 acts as a condenser, aiding transition of the refrigerant from a high-pressure gas to a high-pressure liquid and releasing heat in the process. The outdoor heat exchanger 124 acts as an evaporator, aiding transition of the refrigerant from a low-pressure liquid to a low-pressure gas, thereby absorbing heat from the outdoor environment. If cooling is desired, the outdoor unit 104 has flow-control devices 126 that reverse the flow of the refrigerant, allowing the outdoor heat exchanger 124 to act as a condenser and allowing the indoor heat exchanger 120 to act as an evaporator. The flow control devices 126 may also act as an expander to reduce the pressure of the refrigerant flowing therethrough. In other embodiments, the expander may be a separate device located in either the outdoor unit 104 or the indoor unit 106. To facilitate the exchange of heat between the ambient indoor air and the outdoor environment in the described HVAC system 100, the respective heat exchangers 120, 124 have tubing that winds or coils through heat-exchange surfaces, to increase the surface area of contact between the tubing and the surrounding air or environment.

The illustrated outdoor unit 104 may also include an accumulator 128 that helps prevent liquid refrigerant from reaching the inlet of a fixed volume ratio compressor 130. The outdoor unit 104 may include a receiver 132 that helps to maintain sufficient refrigerant charge distribution in the system 100. The size of these components is often defined by the amount of refrigerant employed by the system 100.

The fixed volume ratio compressor 130 receives low-pressure gas refrigerant from either the indoor heat exchanger 120 if cooling is desired or from the outdoor heat exchanger 124 if heating is desired. The fixed volume ratio compressor 130 then compresses the gas refrigerant to a higher pressure based on a compressor volume ratio, namely the ratio of a discharge volume, the volume of gas outputted from the fixed volume ratio compressor 130 once compressed, to a suction volume, the volume of gas inputted into the fixed volume ratio compressor 130 before compression. In the illustrated embodiment, the compressor is a multi-stage compressor 130 that can transition between at least a two volume ratios depending on whether heating or cooling is desired. In other embodiments, the system 100 may be configured to only cool or only heat, and the fixed volume ratio compressor 130 may be a single stage compressor having only a single volume ratio.

The volume ratio of the fixed volume ratio compressor 130 is a significant factor in determining the overall efficiency of the system 100. Therefore, having the optimal volume ratio for the fixed volume ratio compressor 130 helps to maximize the efficiency of the system 100 and minimize compressor losses for a fixed volume ratio compressor 130 using a selected refrigerant, such as, but not limited to, R410A, R32, and R454B. The thermodynamic properties of the refrigerant are also to be considered when selecting the optimal volume ratio since the optimal volume ration changes depending on the refrigerant used in the system 100. Further, as the environmental conditions during the operation of the fixed volume ratio compressor 130 directly impact the efficiency of the fixed volume ratio compressor 130, it is beneficial to calculate compressor losses at several different environmental operating conditions to determine the optimal volume ratio.

Figure 2:
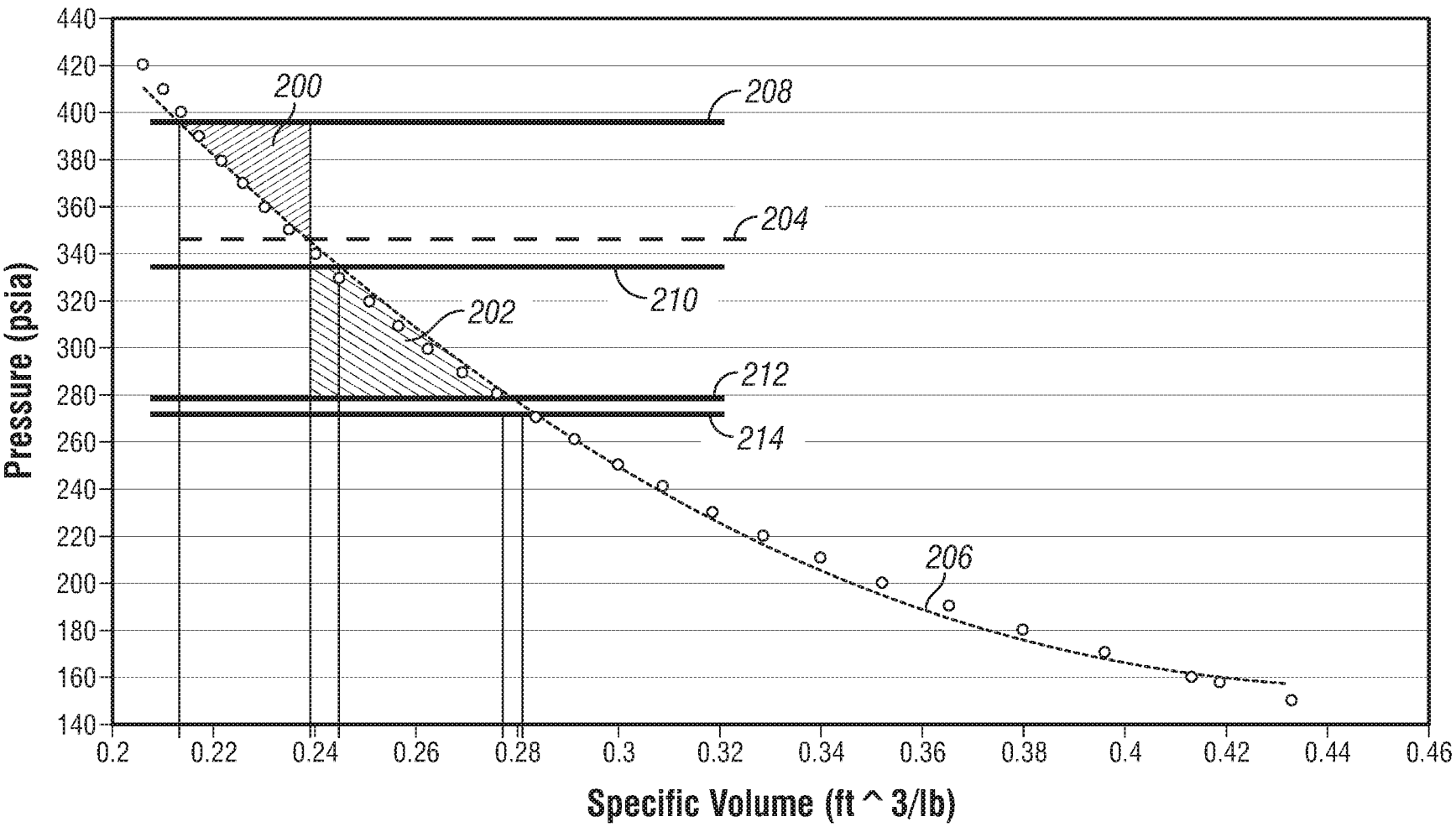
FIG. 2 is a graph depicting a relationship between pressure and specific volume of a refrigerant in an HVAC system.

For example, FIG. 2 illustrates compressor losses, i.e., under-compression 200 of a refrigerant and over-compression 202 of a refrigerant, for a specific refrigerant at a selected volume ratio 204. The curve 206 shown in FIG. 2 represents a polytropic process for the refrigerant and illustrates the relationship between specific volume, which is directly related to the volume ratio, and pressure for the refrigerant. The graph also shows the required refrigerant pressure to reach the ideal specific volume, and, therefore, the ideal volume ratio, for the refrigerant at each of four different environmental conditions 208, 210, 212, 214. The ideal specific volume for each of the four environmental conditions 208, 210, 212, 214 are to be calculated using methods known to those skilled in the art.

The four selected environmental operating conditions may correspond to the environmental conditions used by an organization, such as the Air Conditioning, Heating, and Refrigeration Institute ("AHRI"), when determining system efficiency using a known efficiency standard, such as the integrated energy efficiency ratio ("IEER"), the seasonal energy efficiency ratio ("SEER"), or the heating seasonal performance factor ("HSPF"). However, the invention is not thereby limited. There may be one, two, three, five, or more environmental conditions used when determining compressor losses. Additionally, the environmental operating conditions may be set based on the intended geographical location of the system 100, instead of the operating conditions set by an organization such as AHRI for a specific efficiency standard.

Since a fixed volume ratio compressor operates at a single volume ratio and, therefore, single specific volume, there will be compressor losses due to either under-compression 200, where the refrigerant is not sufficiently compressed to reach the ideal specific volume, or over-compression 202, where the refrigerant is compressed above the pressure required to reach the ideal specific volume, when the compressor is operated at each of the environmental conditions 208, 210, 212, 214. The compressor losses at each environmental condition 208, 210, 212, 214 are found by calculating the area either above the refrigerant curve, which is under-compression 200, or under the refrigerant curve, which is over-compression 202, between the specific volume and associated pressure related to the selected volume ratio and the ideal specific volume and associated pressure for the environmental condition 208, 210, 212, 214. Additional losses due to friction, leakage, or other sources known to those skilled in the art may also be included when determining total compressor losses.

Figure 3:
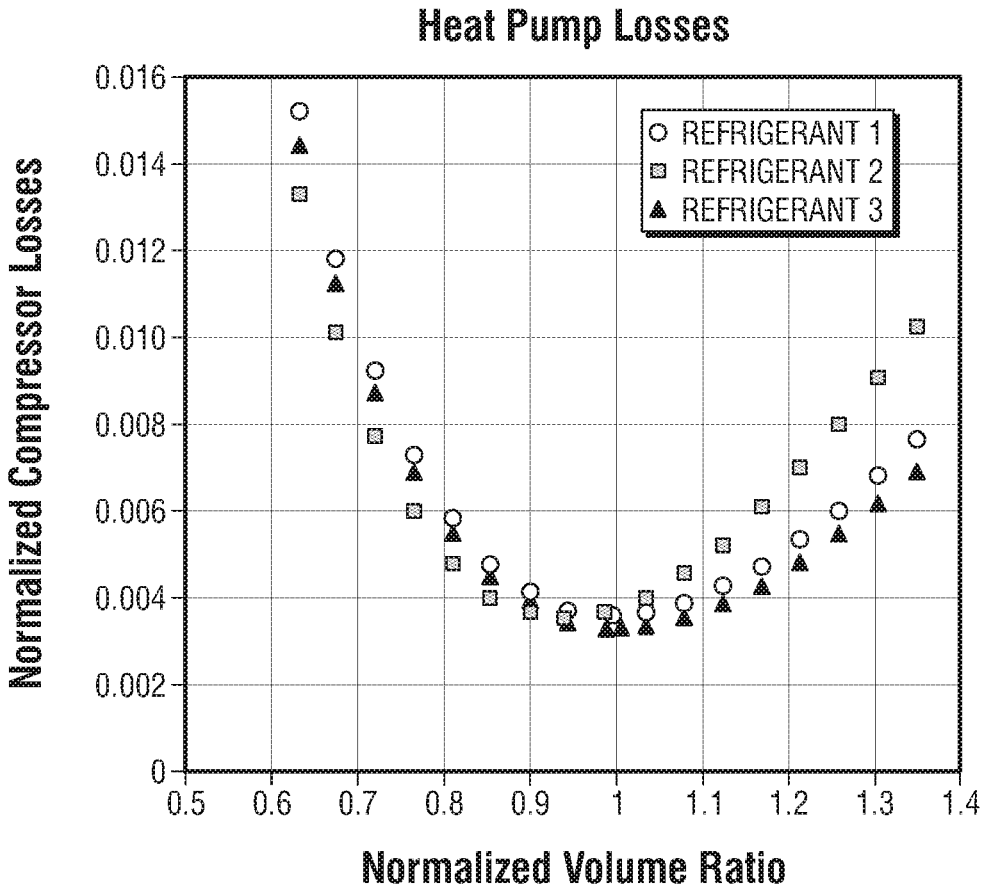
FIG. 3 is a graph depicting normalized compressor losses as a function of normalized compressor volume ratio for several refrigerants.

After the compressor losses at each environmental condition are calculated, they can be weighted according to the estimated time the fixed volume ratio compressor 130 will spend at each operating condition over the life of the compressor 130. After the weights have been applied to the compressor losses at each operating conditions, the total compressor losses across the weighted environmental conditions can be calculated for a range of volume ratios to determine the optimal volume ratio to reduce compressor losses. The compressor losses may be calculated for volume ratios within a range of 1.5 to 3.5. However, the compressor losses may also be calculated for volume ratios below 1.5 and above 3.5 if necessary to find the volume ratio having the lowest compressor losses. A graph depicting volume ratios and their associated compressor losses can be seen in FIG. 3. However, the volume ratios and associated losses have been normalized based on Refrigerant 1 to show that the optimal volume ratio, the lowest point of the respective curves, will change depending on the refrigerant.

Figure 4:
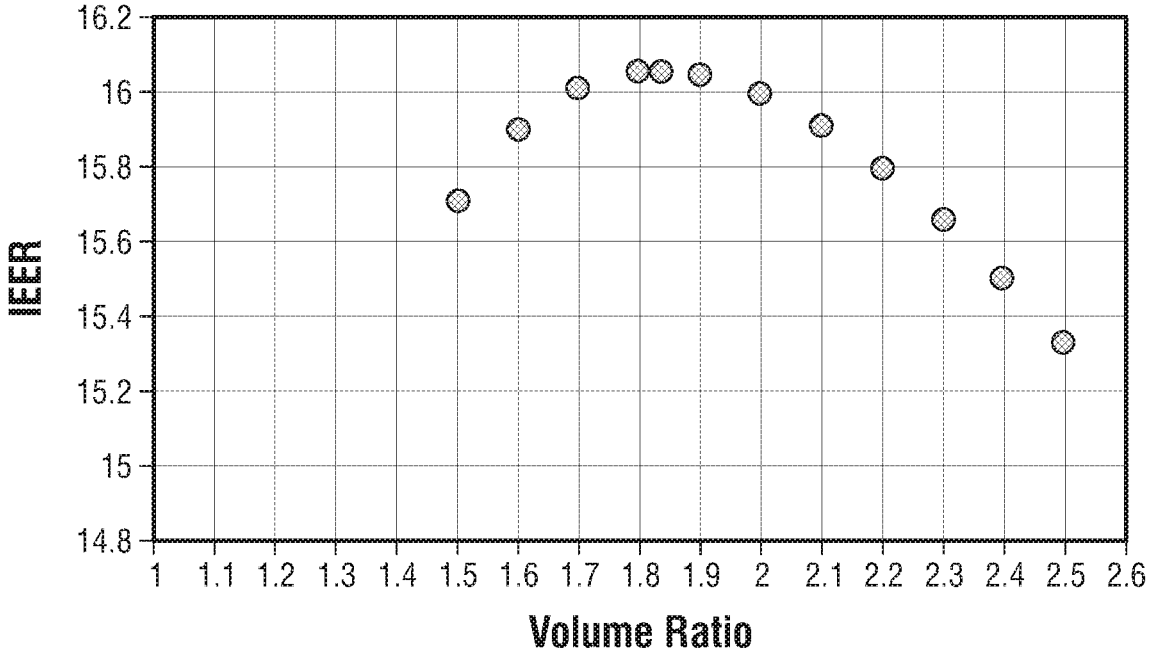
FIG. 4 is a graph depicting system integrated energy efficiency ratio ("IEER") as a function of compressor volume ratios.

Alternatively or in addition to calculating the compressor losses for the fixed volume ratio compressor 130, the efficiency of the system 100 can be determined for a system using fixed volume ratio compressors having known volume ratios in accordance with a known efficiency standard, such as IEER, SEER, or HSPF. The system efficiency may be calculated for volume ratios within a range of 1.5 to 2.5, as shown in FIG. 4, to determine the volume ratio associated with the highest system efficiency, the highest point in the curve. However, the system efficiency may also be calculated for volume ratios below 1.5 and above 3.5 if necessary to find the volume ratio associated with the highest system efficiency. Additionally, FIG. 4 depicts the system efficiency for only one refrigerant. As discussed above, the overall system efficiency and most efficient volume ratio will vary depending on the refrigerant used in the system.

Figure 5:
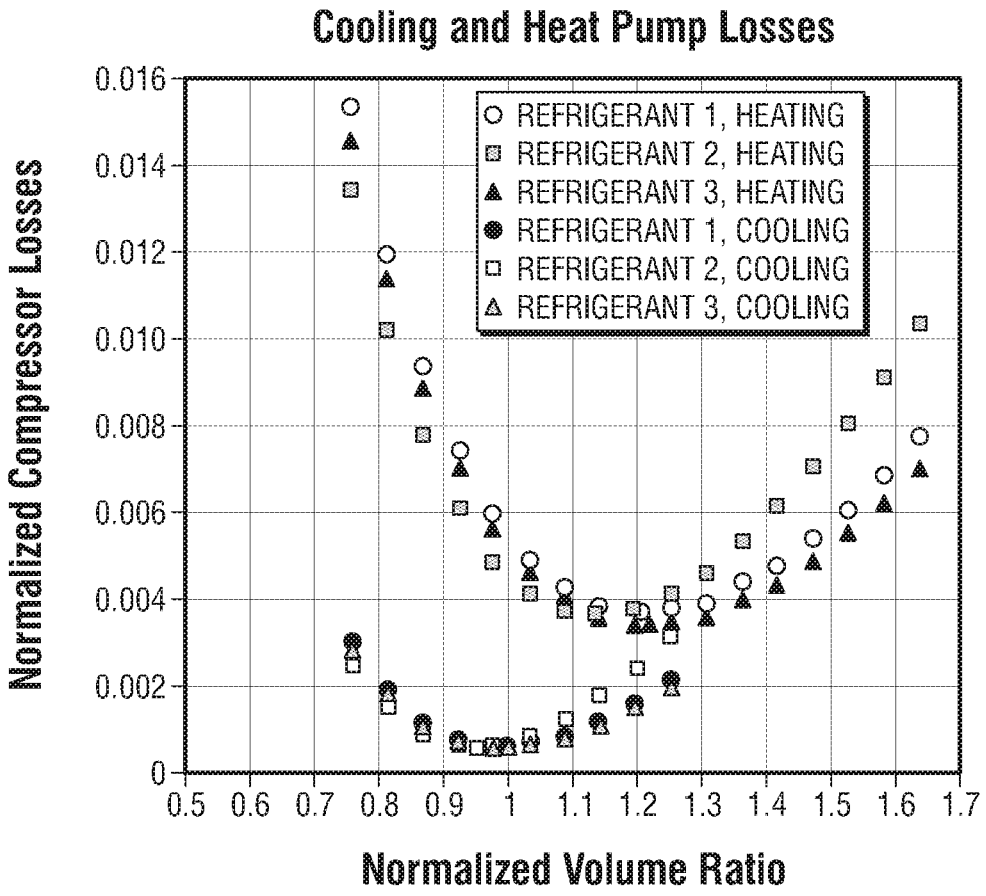
FIG. 5 is a graph depicting normalized compressor losses as a function of normalized compressor volume ratios for several refrigerants.

When determining the optimal efficiency ratios for multi-stage compressors used with systems that operate as both a heating system and a cooling system, a similar methodology can be used. However, in such cases, the compressor losses and/or system efficiency are separately calculated for heating operations and cooling operations. The total losses or system efficiencies can then be calculated for the compressor stage associated with heating and the compressor stage associated with cooling, as shown in FIG. 5, to determine the optimal volume ratio for each stage. The methodology can also be applied to fixed volume ratio compressors having multiple cooling stages, where the compressor losses and/or system efficiency are separately calculated for each cooling stage. The optimal volume ratio can then be determined for each stage of the multi-stage compressor.

Figure 6:
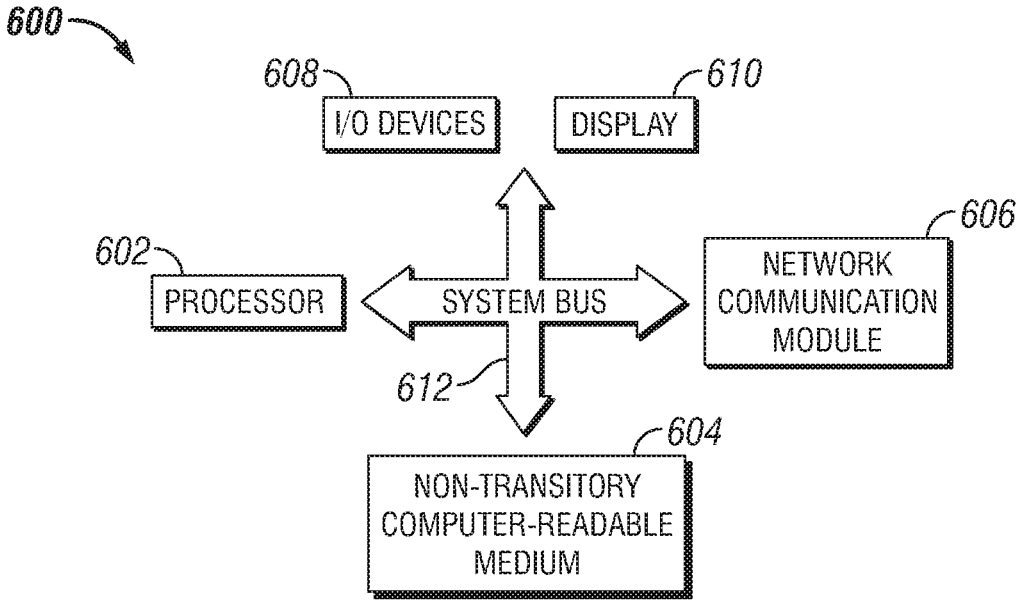
FIG. 6 is a block diagram of a computer system, according to one or more embodiments.

FIG. 6 is a block diagram of a computer system 600 that can be used to calculate compressor losses for fixed volume ratio compressors 130 having known volume ratios and system efficiencies for HVAC systems that include compressors having known volume ratios, as described above. The computer system 600 includes at least one processor 602, a non-transitory computer readable medium 604, an optional network communication module 606, optional input/output devices 608, and an optional display 610 all interconnected via a system bus 612. Software instructions executable by the processor 602 for implementing software instructions stored within the computer system 600 in accordance with the illustrative embodiments described herein, may be stored in the non-transitory computer readable medium 604 or some other non-transitory computer-readable medium.

Although not explicitly shown in FIG. 6, it will be recognized that the computer system 600 may be connected to one or more public and/or private networks via appropriate network connections. It will also be recognized that software instructions may also be loaded into the non-transitory computer readable medium 604 from a CD-ROM or other appropriate storage media via wired or wireless means.

Further Examples Include:

Example 1 is a method for designing a compressor operable to compress a refrigerant. The method includes determining operating conditions for the compressor. The method also includes weighting the operating conditions. The method further includes determining a compressor volume ratio based on the refrigerant and the weighted operating conditions.

In Example 2, the embodiments of any preceding paragraph or combination thereof further include wherein weighting the operating conditions includes estimating time spent at each operating condition over the life of the compressor. Weighting the operating conditions further includes weighting the operating conditions based on the time estimates.

In Example 3, the embodiments of any preceding paragraph or combination thereof further include wherein determining the operating conditions includes estimating the operating conditions for the compressor at a selected geographic location.

In Example 4, the embodiments of any preceding paragraph or combination thereof further include wherein the operating conditions and the weights of the operating conditions are selected based on an efficiency standard.

In Example 5, the embodiments of any preceding paragraph or combination thereof further include wherein determining the compressor volume ratio includes calculating at least one of compressor efficiencies or compressor losses for multiple compressor volume ratios based on the refrigerant and the weighted operating conditions. Determining the compressor volume ratio further includes selecting the compressor volume ratio having the highest compressor efficiency or the lowest compressor losses.

In Example 6, the embodiments of any preceding paragraph or combination thereof further include wherein the compressor volume ratios comprise compressor volume ratios within a range of 1.5 to 3.5.

In Example 7, the embodiments of any preceding paragraph or combination thereof further include wherein the compressor is a multi-stage compressor. Further, determining operating conditions for the compressor includes determining a first set of operating conditions corresponding to a first compressor stage. Determining operating conditions for the compressor also includes determining a second set of operating conditions corresponding to a second compressor stage. Further, weighting the operating conditions comprises weighting the operating conditions within the respective sets of operating conditions. Further, determining a compressor volume ratio includes determining a compressor volume ratio for the first compressor stage based on the refrigerant and the first set of weighted operating conditions. Determining a compressor volume ratio also includes determining a compressor volume ratio for the second compressor stage based on the refrigerant and the second set of weighted operating conditions.

In Example 8, the embodiments of any preceding paragraph or combination thereof further include manufacturing a compressor based on the determined compressor volume ratio.

Example 9 is an HVAC system. The HVAC system includes an evaporator, a condenser, an expander, and a compressor. The compressor is operable to compress a refrigerant and has a volume ratio. The volume ratio is determined based on the refrigerant and weighted operating conditions.

In Example 10, the embodiments of any preceding paragraph or combination thereof further include wherein the weighted operating conditions are based on time spent at each of multiple operating conditions for a selected geographic location over the life of the compressor.

In Example 11, the embodiments of any preceding paragraph or combination thereof further include wherein the weighted operating conditions are selected based on an efficiency standard.

In Example 12, the embodiments of any preceding paragraph or combination thereof further include wherein the volume ratio has at least one of the lowest compressor losses based on the refrigerant and the weighted operating conditions or the highest compressor efficiency based on the refrigerant and the weighted operating conditions of a group of compressor volume ratios.

In Example 13, the embodiments of any preceding paragraph or combination thereof further include wherein the group of compressor volume ratios comprises compressor volume ratios within a range of 1.5 to 3.5.

In Example 14, the embodiments of any preceding paragraph or combination thereof further include wherein the compressor is a multi-stage compressor having a first volume ratio and a second volume ratio, wherein the first volume ratio is determined based on the refrigerant and a first set weighted operating conditions and the second volume ratio is determined based on the refrigerant and a second set weighted operating conditions.

Example 15 is a method for designing a compressor operable to compress a refrigerant. The method includes determining operating conditions for the compressor. The method also includes weighting the operating conditions. The method further includes determining a compressor volume ratio based on the refrigerant and the weighted operating conditions. The method also includes manufacturing a compressor based on the determined compressor volume ratio.

In Example 16, the embodiments of any preceding paragraph or combination thereof further include wherein weighting the operating conditions includes estimating time spent at each operating condition over the life of the compressor. Weighting the operating conditions further includes weighting the operating conditions based on the time estimates.

In Example 17, the embodiments of any preceding paragraph or combination thereof further include wherein determining the operating conditions includes estimating the operating conditions for the compressor at a selected geographic location.

In Example 18, the embodiments of any preceding paragraph or combination thereof further include wherein the operating conditions and the weights of the operating conditions are selected based on an efficiency standard.

In Example 19, the embodiments of any preceding paragraph or combination thereof further include wherein determining the compressor volume ratio includes calculating at least one of compressor efficiencies or compressor losses for multiple compressor volume ratios based on the refrigerant and the weighted operating conditions. Determining the compressor volume ratio further includes selecting the compressor volume ratio having the highest compressor efficiency or the lowest compressor losses.

In Example 20, the embodiments of any preceding paragraph or combination thereof further include wherein the compressor is a multi-stage compressor. Further, determining operating conditions for the compressor includes determining a first set of operating conditions corresponding to a first compressor stage. Determining operating conditions for the compressor also includes determining a second set of operating conditions corresponding to a second compressor stage. Further, weighting the operating conditions comprises weighting the operating conditions within the respective sets of operating conditions. Further, determining a compressor volume ratio includes determining a compressor volume ratio for the first compressor stage based on the refrigerant and the first set of weighted operating conditions. Determining a compressor volume ratio also includes determining a compressor volume ratio for the second compressor stage based on the refrigerant and the second set of weighted operating conditions.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method for installing a refrigeration circuit, the method comprising:

installing a single fixed volume ratio compressor operable to compress a refrigerant, the single compressor having a compressor volume ratio and compressor losses designed by:

determining the compressor volume ratio based on thermodynamic properties of the refrigerant and at least one of:

the lowest total compressor losses calculated from compressor losses of the compressor at selected environmental operating conditions weighted based on an estimated time spent at each operating condition over the life of the compressor; or a highest compressor efficiency for the compressor calculated in accordance with an efficiency standard using environmental operating conditions set by the efficiency standard; and calculating at least one of an area above a polytropic curve at the selected environmental conditions to determine a compressor loss of the compressor for an under-compression of the refrigerant or the area below the polytropic curve at the selected environmental conditions to determine the compressor loss of the compressor for an over-compression of the refrigerant;

installing an indoor heat exchanger and an outdoor heat exchanger in the refrigeration circuit such that the refrigerant can flow from the compressor selectively through one of either the indoor heat exchanger or the outdoor heat exchanger; and installing an expander in the refrigeration circuit that expands the refrigerant from the one of either the indoor heat exchanger or the outdoor heat exchanger, wherein the refrigeration circuit flows the refrigerant from the expander through the other of the indoor heat exchanger or the outdoor heat exchanger and then back to the compressor.

2. The method of claim 1, wherein the selected environmental operating conditions are selected based on estimating the operating conditions for the compressor at a selected geographic location.

3. The method of claim 1, wherein the selected environmental operating conditions are selected based on the efficiency standard.

4. The method of claim 1, wherein the total compressor losses and compressor efficiency are calculated for compressor volume ratios within a range of 1.5 to 3.5.

5. The method of claim 1, wherein:

the fixed volume ratio compressor is a multi-stage compressor having a first volume ratio for a first compressor stage and a second volume ratio for a second compressor stage; and determining the compressor volume ratio further comprises:

determining the first compressor volume ratio based on the thermodynamic properties of the refrigerant and a first set of selected environmental operating conditions; and determining a second compressor volume ratio based on the thermodynamic properties of the refrigerant and a second set of selected environmental operating conditions.

6. A method for manufacturing a single fixed volume ratio compressor operable to compress a refrigerant, the method comprising:

determining a compressor volume ratio based on thermodynamic properties of the refrigerant and at least one of:

the lowest total compressor losses calculated from compressor losses of the compressor at selected environmental operating conditions weighted based on an estimated time spent at each operating condition over the life of the compressor; or a highest compressor efficiency for the compressor calculated in accordance with an efficiency standard using environmental operating conditions set by the efficiency standard;

calculating at least one of an area above a polytropic curve at the selected environmental conditions to determine a compressor loss of the compressor for an under-compression of the refrigerant or the area below the polytropic curve at the selected environmental conditions to determine the compressor loss of the compressor for an over-compression of the refrigerant; and manufacturing the compressor with the determined compressor volume ratio.

7. The method of claim 6, wherein the selected environmental operating conditions are selected based on estimating the operating conditions for the compressor at a selected geographic location.

8. The method of claim 6, wherein the selected environmental operating conditions are selected based on the efficiency standard.

9. The method of claim 6, wherein:

the fixed volume ratio compressor is a multi-stage compressor having a first volume ratio for a first compressor stage and a second volume ratio for a second compressor stage; and determining the compressor volume ratio further comprises:

determining the first compressor volume ratio based on the thermodynamic properties of the refrigerant and a first set of selected environmental operating conditions; and determining a second compressor volume ratio based on the thermodynamic properties of the refrigerant and a second set of selected environmental operating conditions.

* * * * *